United States Patent [19]

Zimmer

[11] 3,992,990

[45] *Nov. 23, 1976

[54] DYESTUFF APPLICATOR FOR SCREEN PRINTER

[76] Inventor: Peter Zimmer, Untere Sparchen 54, Kufstein, Austria

[ * ] Notice: The portion of the term of this patent subsequent to Nov. 25, 1992, has been disclaimed.

[22] Filed: June 2, 1975

[21] Appl. No.: 582,925

Related U.S. Application Data

[63] Continuation of Ser. No. 376,714, July 5, 1973, abandoned.

[30] Foreign Application Priority Data

Aug. 1, 1972 Austria ..... 6651/72

[52] U.S. Cl. ..... 101/120; 118/406

[51] Int. Cl.[2] ..... B41F 15/42

[58] Field of Search ..... 101/115, 116, 119, 120, 101/123, 124, 129, 366; 118/213, 301, 406

[56] References Cited

UNITED STATES PATENTS

| | | | |
|---|---|---|---|
| 846,645 | 3/1907 | Brooks | 101/119 X |
| 3,592,132 | 7/1971 | Weber | 101/119 |
| 3,752,071 | 8/1973 | McKay | 101/125 |
| 3,799,053 | 3/1974 | Rabelow | 101/125 |

*Primary Examiner*—Edgar S. Burr
*Assistant Examiner*—R. E. Suter
*Attorney, Agent, or Firm*—Ernest G. Montague; Karl F. Ross; Herbert Dubno

[57] ABSTRACT

A dyestuff applicator for an apertured printing screen, curved about a horizontal axis, comprises an axially extending supply tube within an elongate casing supported thereon, the open casing bottom being surrounded by flanges in clamping engagement with an elastic membrane curving downwardly toward the underlying screen surface under pressure of the overlying liquid and of a limitedly vertically movable loading frame. A metallic foil, curved cylindrically about the screen axis, is interposed between the membrane and the screen, the foil and the membrane being provided with aligned openings which form an outlet for the dyestuff liquid along a median zone of contact bracketed by the frame.

8 Claims, 2 Drawing Figures

DYESTUFF APPLICATOR FOR SCREEN PRINTER

CROSSREFERENCE TO RELATED APLICATIONS

This is a continuation of my copending application Ser. No. 376,714, filed 5 July 1973 and now abandoned, and relates to subject matter disclosed in my copending applications Ser. Nos. 320,739 filed 3 Jan. 1973 and 364,560 filed 29 May 1973, now U.S. Pat. Nos. 3,89,896 and 3,921,520.

FIELD OF THE INVENTION

My present invention relates to a dyestuff applicator for a printing machine of the type wherein an apertured cylindrical screen is rotatable about a horizontal axis and surrounds a supply tube for liquid dyestuff which is to be discharged through perforations of the screen onto a substrate for imprinting the latter in accordance with a predetermined pattern.

BACKGROUND OF THE INVENTION

In my aforementioned copending applications Ser. Nos. 320,739 and 364,560 I have disclosed different structures defining the discharge gap at the bottom of the applicator housing. According to application Ser. No. 320,739, the gap is formed between two sealing strips weighted down by two parallel rods attracted downwardly by a magnetic force. In application Ser. No. 364,560 I have disclosed and claimed a similar applicator wherein a downwardly convex bottom member of elastic material, forming a discharge slot for the dyestuff parallel to the cylinder axis, spans the bottom of the applicator housing and is juxtaposed with a metallic foil having openings registering with the discharge slot, this foil acting as a reinforcement designed to prevent enlargement of the slot. The elastic bottom member and the associated reinforcing foil are cylindrically curved and can be weighted down by rods similar to those disclosed in my earlier application Ser. No. 320,739.

OBJECT OF THE INVENTION

The object of my present invention is to provide an applicator of this general type whose bottom member, designed as an elastic diaphragm or membrane, has a shape different from that of the juxtaposed metal foil so as to be more readily able to adapt itself to the configuration of the applicator housing while allowing the foil to conform to screen surface the underlying substrate.

SUMMARY OF THE INVENTION

I realize this object, in accordance with my present invention, by mounting the elastic membrane and the relatively rigid foil on the open bottom of the applicator housing or casing in such a way that the foil contacts the membrane along a median outlet zone extending parallel to the screen axis, the foil being cylindrically curved about that axis whereas the membrane curves down toward the screen surface above the foil in axial and transverse planes. Such a two-dimensional curvature can be maintained by loading means bearing down upon the membrane within the case around the aforementioned median zone, specifically by a frame with parallel axially extending rods flanking that zone and with headpieces interconnecting the rods beyond the zone ends. The frame is advantageously provided with retaining means limiting its vertical mobility relative to the casing.

BRIEF DESCRIPTION OF THE DRAWING

The above and other features of my invention will now be described in greater detail with reference to the accompanying drawing in which.

SPECIFIC DESCRIPTION

Figure 1:
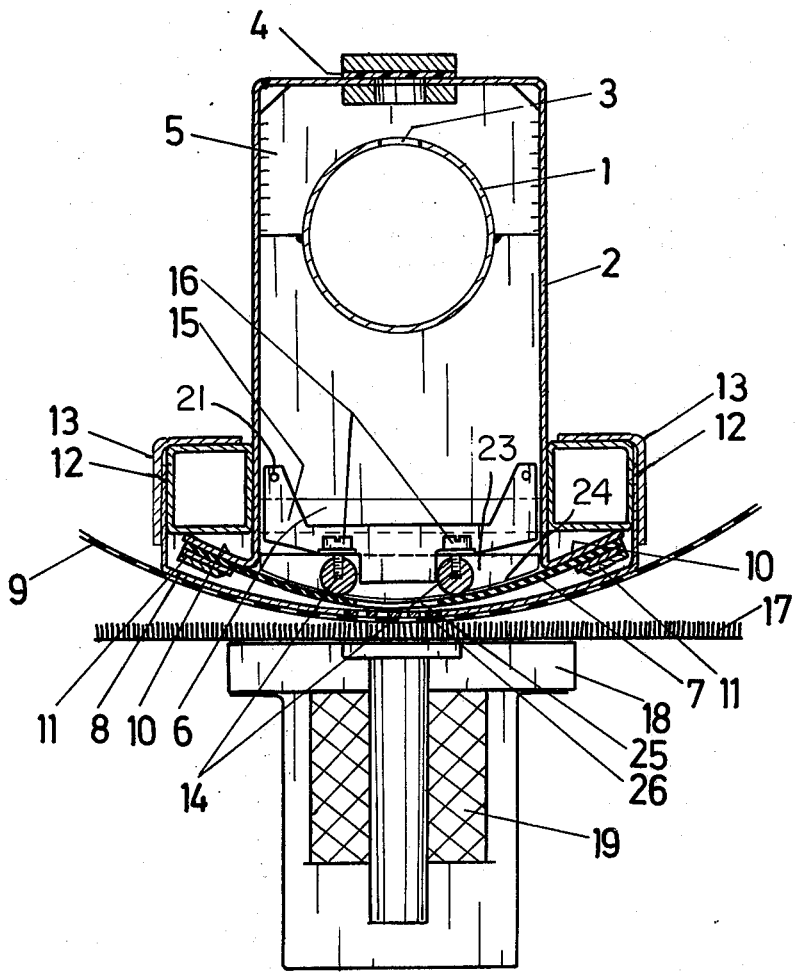
FIG. 1 is a cross-sectional view of a dyestuff applicator embodying my invention.

In the device shown in the drawing, printing dyestuff flows through a supply tube 1 into the interior of an applicator casing 2. The dyestuff leaves the tube 1 through upper exit ports 3 overlain by disks 4 through which, if necessary, nonillustrated throttles can be inserted which partially or wholly close these openings. The applicator casing 2 is stabilized by a transverse plate 5 in its upper region and cross-bars 6 in its lower region. A further stiffening of the walls of casing 2 is realized with the aid of hollow beams 12 which extend completely around the casing. These reinforcements allow the use of a casing of small weight yet capable of withstanding its internal pressures without excessive deformation.

Figure 2:
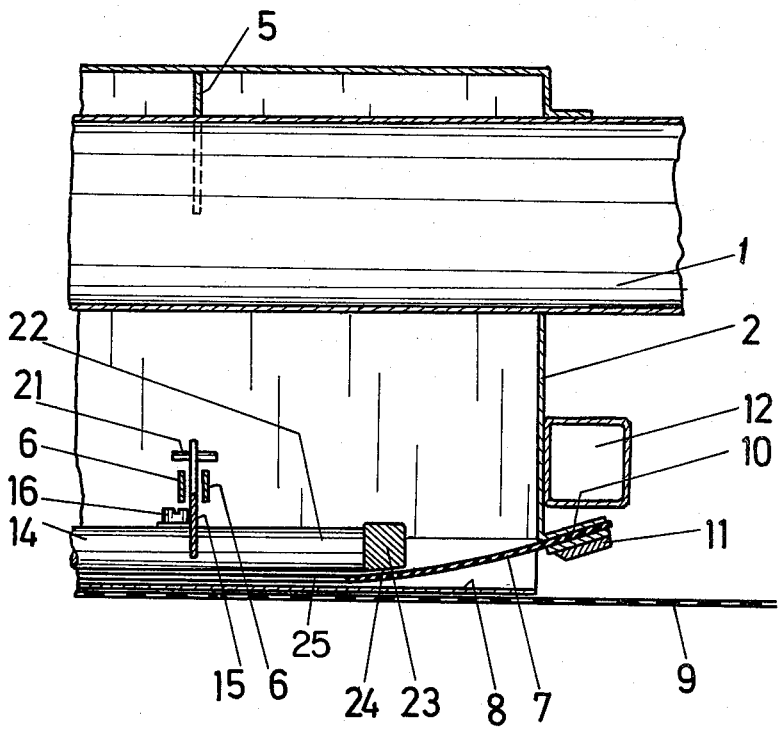
FIG. 2 is a fragmentary axial sectional view of an end portion of the applicator shown in FIG. 1.

A thin elastic membrane 7, e.g. of rubber, spans the open bottom of casing 2 against which it is firmly attached along lateral flanges 10 with the aid of clamping strips 11. In contradistinction to a metal foil 8 of limited deformability, extending across the casing bottom below membrane 7, the latter can deform rather freely and curves downwardly not only in a transverse plane but also at the ends of the applicator as seen in FIG. 2. Metal foil 8 conforms closedly to the curvature of a cylindrical printing screen 9 while being limitedly movable in a vertical direction relatively to casing 2, being held independently of the membrane-engaging means 10, 11 between the longitudinally extending beams 12 and angular profiles 13 fastened thereto. Membrane 7 is loaded by a pair of weighting rods 14 which are firmly secured to a spacing element 15 by screws 16 and extend parallel to the screen axis. The spacing element 15 insures that the weighting rods 14 are kept a certain distance apart from each other as they bear upon membrane 7 which in turn contacts the foil 8 along a median longitudinal zone. The contact pressure can be intensified by electromagnets 19 positioned underneath a table 18 which supports a web 17 to be imprinted. Alternatively, compression springs (not shown) can be interposed between the plate 5 and the associated spacer 15. In rolling over thicker portions of substrate 17, the perforated screen 9 will flex upwardly and lift the foil 8 whose vertical mobility is limited by the rods 14 and spacing elements 15. Abutments 21, by coming to rest on the cross-bars 6, limit the descent of the spacing elements 15 and of the weighting rods 14 attached thereto.

The printing dyestuff which flows out from the supply tube 1 through the openings 3 into casing 2 is distributed in the longitudinal direction of the casing and passes through an outlet slot 25 in the membrane 7 as well as through registering openings 26 in the foil 8 and apertures of the perforated screen 9 onto the web 17.

The ends 22 of the rods 14 are interconnected by headpieces 23 whose lower surfaces 24 substantially conform to the cylindrical curvature of the rotary screen 9. The undersurface 24 of the headpiece 23 illustrated in FIG. 2 will be seen to be slightly beveled in an axial plane so as to facilitate the upward curving of membrane 7 beyond the outlet zone 25, 26. Rods 14, flanking that outlet zone, form with their spacers 15 and headpieces 23 a loading frame which brackets the discharge slot 25 and supplements the pressure of the liquid body within casing 2 to impart the illustrated downward curvature in two planes to membrane 7. As will be apparent from FIG. 1, the combined cross-sectional area of outlet openings 26 in the cylindrically curved metal foil 8 is less than the cross-sectional area of the overlying discharge slot 25 of rubber membrane 7.

What we claim is:

1. A dyestuff applicator for a printer provided with an apertured screen rotatable about a horizontal axis, comprising:

a supply tube parallel to said axis provided with at least one exit port for liquid dyestuff;

a casing surrounding said tube and supported thereon, said casing being provided with an open bottom overlying an inner screen surface;

an elastic membrane secured to said casing and spanning said open bottom while curving downwardly toward said screen surface in two vertical planes including said axis and transverse thereto, respectively, said membrane being provided with an outlet for said dyestuff in an axially extending median zone; and a relatively rigid foil secured to said casing and interposed between said membrane and said screen surface, said foil having a cylindrical curvature substantially conforming to that of said screen surface and contacting said membrane along said median zone, said foil having openings registering with said outlet for the passage of dyestuff through apertures of the screen to an underlying substrate to be imprinted.

2. A dyestuff applicator as defined in claim 1 wherein said outlet has a cross-sectional area exceeding the combined cross-sectional area of said openings.

3. A dyestuff applicator as defined in claim 1 wherein said membrane is made of elastomeric material and said foil is made of metal.

4. A dyestuff applicator as defined in claim 1 wherein said casing is provided with clamping means extending around its bottom for holding said membrane in position.

5. A dyestuff applicator as defined in claim 4 wherein said foil is held by a mounting independent of said clamping means extending axially alongside said casing.

6. A dyestuff applicator as defined in claim 1 further comprising loading means bearing down upon said membrane within said casing adjacent said median zone.

7. A dyestuff applicator as defined in claim 6 wherein said loading means comprises a vertically movable frame with a pair of parallel, axially extending rods flanking said median zone and with headpieces interconnecting said rods outside said zone, said frame being provided with retaining means limiting its vertical mobility relative to said casing.

8. A dyestuff applicator as defined in claim 7 wherein said headpieces have undersurfaces sloping upwardly in the direction of said axis with increasing distance from said median zone.

* * * * *